US005543284A

United States Patent [19]

Verbeeck

[11] Patent Number: 5,543,284

[45] Date of Patent: Aug. 6, 1996

[54] PREPARATION METHOD OF REGULAR SILVER HALIDE LIGHT-SENSITIVE EMULSIONS COMPRISING SILVER HALIDE CRYSTALS RICH IN CHLORIDE AND MATERIAL COMPRISING SAID EMULSIONS

[75] Inventor: Ann Verbeeck, Begijnendijk, Belgium

[73] Assignee: AGFA-Gevaert, N.V., Mortsel, Belgium

[21] Appl. No.: 417,953

[22] Filed: Apr. 6, 1995

[30] Foreign Application Priority Data

May 9, 1994 [EP] European Pat. Off. ..... 94201283

[51] Int. Cl.[6] ..... G03C 1/015

[52] U.S. Cl. ..... 430/569; 430/567

[58] Field of Search ..... 430/569, 567

[56] References Cited

U.S. PATENT DOCUMENTS 3,637,391 1/1972 Saleck et al. ..... 430/569

FOREIGN PATENT DOCUMENTS 0392092 10/1990 European Pat. Off. ..... 430/569
0517961 12/1992 European Pat. Off. ..... 430/569
0528476 2/1993 European Pat. Off. ..... 430/569

*Primary Examiner*—Mark F. Huff
*Attorney, Agent, or Firm*—Breiner & Breiner

[57] ABSTRACT

A method is disclosed to prepare a photographic light-sensitive silver halide emulsion, containing regular silver halide crystals rich in chloride having a predictable size distribution and wherein said method comprises the steps of precipitating silver halide crystals rich in chloride by means of the double-jet or triple-jet technique in colloidal silica having a particle size from 0.003 μm to 0.30 μm as a protective colloid in the absence of any polymeric compound(s) capable of forming hydrogen bridges with colloidal silica, but always in the presence of an onium compound, wherein the ratio by weight of said colloidal silica to the said onium compound(s) is between 3 and 75; controlling the nucleation and growth steps by means of variable flow rate(s) of the aqueous solutions of silver nitrate and chloride containing salts, and/or by means of constant pAg-values during said steps in the vessel in order to determine the number of nuclei quantitatively in the nucleation step and to avoid renucleation in the growth step, and wherein at every moment the total amount of monovalent ions of the electrolyte present during both steps is less than 1.0 molar; desalting the reaction medium and redispersing the silver halide, chemically ripening the silver halide crystals rich in chloride and adjusting the ratio by weight of the colloidal silica sol to the amount of silver halide, expressed as the equivalent amount of silver nitrate to a value of at least 0.03 at every moment throughout the precipitation stage.

11 Claims, No Drawings

PREPARATION METHOD OF REGULAR SILVER HALIDE LIGHT-SENSITIVE EMULSIONS COMPRISING SILVER HALIDE CRYSTALS RICH IN CHLORIDE AND MATERIAL COMPRISING SAID EMULSIONS

FIELD OF THE INVENTION

The present invention relates to a preparation method of photographic light-sensitive regular silver halide emulsion crystals rich in chloride and to light-sensitive photographic materials wherein the corresponding emulsions are used.

BACKGROUND OF THE INVENTION

The effects of various precipitation conditions on the formation of stable AgBr crystals have been studied in a balanced double-jet precipitation by Leubner, Wey and Jagannathan and have been disclosed in e.g. Phot. Sc. Eng., Vol. 21 (1977), p. 14, Vol. 23 (1977), p. 248–252 and Vol. 24 (1980), p. 268–272: in J. Imaging Sci., Vol. 34(1990), p. 202–206: in J. Cryst. Growth, Vol. 51 (1981), p. 601–606: and in "Proceedings ICPS Int. Congress of Phot. Science 1986": Progress in Basic Principles of imaging Systems, p. 60.

From these documents the number of nuclei generated during the nucleation stage can be calculated in a semi-empirical way, provided that the values in the reaction vessel of pAg, temperature, concentration of silver complexing reagents and flow rate of the silver and halide containing solutions are controlled during the said stage.

In these well-defined circumstances the crystal size distribution at the end of the precipitation stage is perfectly predictable but an important condition is that during the process of precipitation, proceeding in an aqueous solution of gelatin as protective colloid, two principal stages can be distinctly provided, namely a nucleation stage and a growth stage.

During the nucleation stage no agglomeration may occur so that the number of nuclei formed stays predictable, whereas during the growth stage further control is required in such a way that no renucleation can appear.

Although playing a crucial role in both stages of the precipitation, the role of the protective colloid is sometimes underestimated: said protective colloid has to be considered, not only as a dispersing medium for the fully grown crystals, but particularly as a stabilizing medium for the nuclei. So aggregation of nuclei can be prevented and during the further crystal growth stage the interaction of the protective colloid with the growing crystal surface moderates the crystal growth rate, thereby preventing renucleation as has been suggested by Antoniades and Wey in J. Imaging Sci. and Technol. Vol. 36 (1992), p. 517–524.

From the considerations given above it can be concluded that the protective colloid is determining to a large extent the average crystal diameter and the homogeneity of the crystal size distribution and is offering the possibility to controll the crystal size and the crystal size distribution.

Moreover the protective colloid is also determining the physical properties of the coated film material wherein the silver halide emulsions are incorporated. Properties as e.g. dimensional stability, scratchability, curl, pressure sensitivity and sludge formation after processing are highly dependant on the choice of the protective colloid. A phenomenon like pressure sensitivity may appear as pressure marks, pressure sensitisation or desensitisation, wherein both the protective colloid and the coated matrix have to dissipate the energy developed by the pressure force when the coated layer is dried and deformed afterwards in packaging, before and after exposure and by processing. As adsorption of the protective colloid at the crystal surface occurs development characteristics are further influenced by the said protective colloid.

As has been set forth in EP-Application No. 528 476 a method of preparing a silver halide light-sensitive photographic material incorporating layers of silver halide precipitated in colloidal silica serving as a protective colloid is given. In this document the silver halides are prepared in colloidal silica, leading to emulsion crystals that are stable at the end of the precipitation, but without having a predictable mean crystal diameter and crystal size distribution. These problems have been overcome as has been described in EP-A No. 93202679, filed Sep. 16, 1993, for the preparation of silver bromide and silver bromoiodide crystals. However the problem remains for the preparation of silver halide crystals rich in chloride having a higher solubility product. From a series of experiments it has become clear that an extrapolation to said crystals rich in chloride of the clearly defined circumstances wherein silver bromide or silver bromoiodide crystals can be prepared is impossible and that other ways to reach the objects of this invention, set forth below, should be explored.

"Silica" silver halide crystals rich in chloride are highly preferred in order to prepare very fine, stable grains.

For use in, e.g., daylight materials, such grains having a diameter of less than 0.15 μm, and more preferably of less than 0.10 μm, cannot be prepared at lower temperatures in gelatinous solutions in the reaction vessel, so that grain growth restrainers are used at the required higher temperatures. Moreover grain growth restrainers have a disturbing influence on sensitometric properties of the emulsions coated therefrom.

Fine grains prepared at low temperature in silica sol as a protective colloid may further be used as "feeding reagent" in Ostwald ripening processes in order to grow coarser and/or less soluble crystals.

Moreover exposure light is diffracted less by silver halide crystals rich in chloride, which is in favour of sharpness, as has been illustrated in EP 580 029.

Further a reproducible preparation method for silica silver halide crystals rich in chloride is preferred because of the better solubility of silver chloride versus other silver halides, resulting in a better archivability (due to a more rapid fixation in the fixer by processing). Moreover varying processing conditions, due to, e.g., exhaustion of processing liquids, have less influence on sensitometric properties, obtained in the processing of silver halide photographic materials, coated from emulsion layers, comprising silver halide crystals rich in chloride. Reduced regeneration volumes can further be expected.

OBJECTS OF THE INVENTION

It is an object of the present invention to provide a method for preparing regular silver halide light-sensitive emulsion crystals rich in chloride and the corresponding emulsions, in a reproducible and perfectly predictable way.

It is a further object to obtain reproducible sensitometric characteristics from the exposed and processed photographic material wherein said regular emulsions have been coated in the emulsion layer(s).

It is especially contemplated for the said photographic material to provide a high and reproducible sensitivity and gradation, a high covering power and the absence of pressure marks in rapid processing applications.

Other objects will become apparent from the description hereinafter.

SUMMARY OF THE INVENTION

According to this invention a method is provided to prepare a photographic light-sensitive silver halide emulsion, containing regular silver halide crystals rich in chloride and wherein said method comprises the following the steps:

precipitating silver halide crystals rich in chloride by means of the double-jet or triple-jet technique in colloidal silica having a particle size from 0.003 μm to 0.30 μm as a protective colloid in the absence of any polymeric compound(s) capable of forming hydrogen bridges with colloidal silica, but always in the presence of an onium compound, wherein the ratio by weight of said colloidal silica to the said onium compound(s) is between 3 and 75:

controlling the nucleation and growth steps by means of variable flow rate(s) of the aqueous solutions of silver nitrate and chloride containing salts, and/or by means of constant pAg-values during the said steps in the vessel in order to determine the number of nuclei quantitatively in the nucleation step and to avoid renucleation in the growth step, and wherein at every moment the total amount of monovalent ions of the electrolyte present during both steps is less than 1.0 molar:

desalting the reaction medium and redispersing the silver halide, chemically ripening the silver halide crystals rich in chloride and adjusting the ratio by weight of the colloidal silica sol to the amount of silver halide, expressed as the equivalent amount of silver nitrate to a value of at least 0.03 at every moment throughout the precipitation stage.

Further according to this invention a method is provided comprising in addition to the above steps the further steps of adding to the redispersed and chemically ripened emulsion an amount of hydrogen-bridge forming polymer and/or colloidal silica so that the ratio of hydrogen bridge-forming polymer to silver halide, expressed as the equivalent amount of silver nitrate, is comprised between 0.05 and 0.40 and the ratio of silica to silver halide expressed as silver nitrate is comprised between 0.03 and 0.30.

The invention also provides a silver halide light-sensitive emulsions rich in chloride, prepared according to this invention, and light-sensitive silver halide photographic materials comprising a support and, provided thereon, at least one hydrophilic colloid layer comprising light-sensitive silica silver halide crystals rich in chloride, prepared according to this invention.

DETAILED DESCRIPTION OF THE INVENTION

The light-sensitive silver halide emulsions comprising silver halide crystals rich in chloride, prepared according to the method used in this invention, are characterized by a regular lattice structure having faces covered with silica particles as silica is used as a protective colloid. Preferred silver halide compositions are silver chloride, silver chloroiodide, with up to 5 mole %, preferably up to 3 mole % of iodide, silver chlorobromide, with up to 25 mole % of bromide or silver chlorobromoiodide, with up to 25 mole % of bromide and up to 5 mole %, and more preferably, up to 3 mole % of iodide.

The said regular lattice structures are characterised by the presence of repetitive elements having a radial symmetry. Well-known are e.g. cubic, octahedral and cubo-octahedral structures of silver halide crystals that are frequently met in photographic materials.

For the precipitation process according to this invention suitable silica sols are commercially available such as the "Syton" silica sols (a trademarked product of Monsanto inorganic Chemicals Div.)0 the "Ludex" silica sols (a trademarked product of du Pont de Nemours & Co., Inc.), the "Nalco" and "Nalcoag" silica sols (trademarked products of Nalco Chemical Co), the "Snowtex" silica sols of Nissan Kagaku K.K. and the "Kieselsol, Types 100, 200, 300, 500 and 600" (trademarked products of Bayer AG). Particle sizes of the silica sol particles are in the range from 3 nm to 30 μm. The smaller particles in the range from 3 nm to 0.3 μm are preferred as the covering degree that can be achieved will be higher and as the protective action of the colloidal silica will be more effective.

During the precipitation of silver halide crystals in colloidal silica as a protective colloid onium compounds as co-stabilizers for the colloidal silica are required as has been disclosed in EP-A 392 092 for which this EP-A is incorporated herein by reference.

Further during the precipitation stage of the regular silver chloride, chloroiodide, chlorobromide or chlorobromoiodide crystals the amount of silica sol and of the onium compound(s), should be optimized so as to avoid uncontrolled formation and growth of aggregates of AgCl, AgCl(I), AgCl(Br) or AgCl(Br,I). This phenomenon is well-known and is called "clumping".

According to this invention it has been found that before the start of the precipitation of silver halide crystals rich in chloride in the presence of colloidal silica, aggregates should be present of colloidal silica together with onium co-stabilizing compounds, wherein said aggregates should act analogously as a protective "polymer" for the silver halide nuclei formed, just as e.g. gelatin. Especially at lower pH values, e.g. at a pH value of 3.0, onium compounds and silica sol particles are forming the required aggregates. This is offering a further advantage in that stable emulsion crystals can be formed at relatively low pH values, e.g. at pH values below 4.0, whereas this is an unfavourable pH range, especially for HIEP gelatins.

According to this invention a method has thus been found of preparing a light-sensitive regular silver halide emulsions rich in chloride by the steps of precipitating silver halide by means of the double-jet or triple-jet technique in colloidal silica having a particle size from 0.003 μm to 0.30 μm as a protective colloid in the absence of any polymeric compound(s) comprising gelatin or its derivatives capable of forming hydrogen bridges with colloidal silica, but in the presence of an onium compound. It is clear that ammonium ions, added during precipitation (e.g. as ammonium chloride), should not be considered as onium ions as the "really intended onium compounds" together with colloidal silica, should already be present in the reaction vessel before the start of the precipitation to form a protective network for the silver halide crystals, rich in chloride, to be formed.

The formation of silver halide nuclei rich in chloride should start in a vessel wherein the ratio by weight of the said colloidal silica to the said onium compound(s) is between 3 and 75, and more preferably between 3 and 30, wherein the average silica sol particle size is between 0.003 an 30 μm, and more preferably between 0.003 and 0.30 μm, and wherein the ratio by weight of the colloidal silica sol to the amount of silver halide, expressed as the equivalent amount of silver nitrate is at least 0.03 at every moment throughout the precipitation step. It should be noted that these three conditions are of crucial importance in order to reach the objects of this invention and that they should be fullfilled simultaneously.

Controlling at least one of the parameters like the temperature, the flow rate(s) of silver and halide containing solutions, pAg and the amount of crystal growth modifier, if present, is required so that the number of nuclei formed during the nucleation step becomes predictable and in order to avoid renucleation during the growth step. In a further stage after the end of the precipitation when a predicted end size of the crystals is obtained, desalting and redispersing of the silver halide emulsion, followed by chemically ripening provides an emulsion comprising silver halide crystals rich in chloride that can be prepared for coating in light-sensitive photographic layers of silver halide photographic materials.

Before starting the precipitation of silver halide emulsion crystals according to this invention an easy way to determine the presence of aggregates of the colloidal silica and the onium compound(s) in the reaction vessel makes use of the measurement of the "turbidity" in the reaction vessel before the start of the precipitation reaction of silver ions and halide ions, the composition of which is rich in chloride. Said "turbidity" can be defined as the "cloudy" or "hazy" appearance in a naturally clear liquid caused by a suspension of colloidal liquid droplets or fine solids". The reduction of the transparancy to visible radiation can be established qualitatively or measured quantitatively. A quantitative measure for the said "turbidity" is the so-called "turbidity coefficient". Said coefficient is a factor in the equation of the law of light absorption which describes the extinction of the incident light beam.

Changes in the transparancy of an aqueous solution of silica sol and an onium compound are indicative for the presence or the absence of an ideal "network-structure" for the silica particles that should act as protective colloidal particles for the silver halide crystals formed. So it has been found experimentally that the ratio by weight of the amount of silica sol versus the onium compounds has to be lower than 75. Values between 3 and 60 are preferred and still more preferred are values between 3 and 30, depending on the particle size of the silica sol, which is preferably from 3 nm to about 3 μm and more preferably from 3 nm to 0.30 μm. After mixing both compounds in the reaction vessel and once the critical value has been attained a turbid solution appears in the reaction vessel, indicating that aggregates are present. As has already explained said aggregates offer the advantage that no aggregation or clumping of silver chloride, silver chloroiodide, silver chlorobromide or silver chlorobromoiodide nuclei appears so that the number of nuclei remains reproducible, not only from batch to batch, but also by scaling up procedures. So it has been observed experimentally that very fine silica particles of e.g. 3 nm require high amounts of onium compounds so that the ratio by weight of silica to onium compounds has a lower value, e.g. 30. Otherwise coarser silica particles of e.g. 30 μm require lower amounts of onium compounds and correspondingly higher ratios by weight of silica to the said onium compounds of about e.g. 300.

During the growth stage following the nucleation step the growth is substiantially diffusion controlled and as a consequence the crystal size at the end of the precipitation is perfectly predictable, de proviso that, according to the method used according to this invention, the total amount of electrolyte present at each moment during both the nucleation and the growth step is less than 1.0 molar and preferably less than 0.6 molar for electrolytes composed of monovalent ions. This critical concentration does not exclusively depend on the charge of the ions present in the solution. Another important factor influencing aggregation and flocculation is the arrangement in order in the so-called "Hofmeister series" of the electrolyte ions present in the solution. Said "Hofmeister series", also called "lyotropic series" is defined as the arrangement of anions or cations in order of decreasing ability to produce coagulation when their salts are added to lyophilic sols. So e.g. the desalting effect of potassium ions is smaller than that of sodium ions or expressed otherwise aggregation and even flocculation occurs if the critical electrolyte concentration is exceeded.

As a consequence there is no analogy between the preferred precipitation circumstances in a medium of colloidal silica sol serving as a protective colloid, to prepare regular silver bromide or silver bromoiodide crystals as described in EP-A No. 93202679, filed Sep. 16, 1993 and the preferred precipitation circumstances for regular crystals rich in chloride disclosed herein.

Moreover in these well-described precipitation circumstances the regular silver halide emulsion crystals rich in chloride, and more preferably the silver chloride, silver chloroiodide, silver chlorobromide or silver chlorobromoiodide emulsion crystals are monodisperse to a variation coefficient of less than 0.20. Further additions of silica (and onium compound(s)) to the precipitation vessel may be necessary during the further precipitation stages, e.g. at the end of the nucleation stage, before growing the nuclei or even during the growth step. Additional amounts of silica and, if necessary onium compound(s), may be added to the reaction vessel in one or more portions or continously in a triple-jet precipitation system. Especially preferred are additions during so called Ostwald ripening stages, e.g. before the flow rate of the silver and/or halide solutions is increased in a double-jet precipitation system.

As onium compounds acting as effective stabilisers, provided that according to this invention an appropriate amount is added to the reaction vessel versus The amount of silica present, the following compounds represented by the following general formulae can be used:

$$A^+X^-$$

wherein $X^-$ represents an anion and $A^+$ represents an onium ion selected from any of the following general formulae:

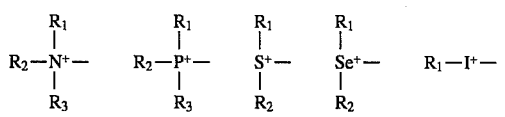

wherein:

each of $R_1$ and $R_3$ (same or different) represents hydrogen, an alkylgroup, a substituted alkyl group, a cycloalkyl group, an aryl group or a substituted aryl group, $R_2$ represents any of the said groups represented by $R_1$ and $R_3$ or the atoms necessary to close a heterocyclic nucleus with either $R_1$ or $R_3$, the said onium ion being linked 1) to a polymer chain, or 2) via a bivalent organic linking group e.g., —O—, —S—, —$SO_2$—, . . . to any other of such onium structure, or 3) directly to any of the groups represented by $R_1$.

Suitable examples of onium compounds are disclosed in U.S. Pat. No. 3,017,270. In said specification suitable examples are mentioned of trialkyl sulfonium salts, polysulfonium salts, tetraalkyl quaternary ammonium salts, quaternary ammonium salts in which the quaternary nitrogen atom is a part of a ring system, cationic polyalkylene oxide salts including e.g. quaternary ammonium and phosphonium and bis-quaternary salts.

Onium salt polymers whereby the onium group may be e.g. an ammonium, phosphonium or sulphonium group, are disclosed in U.S. Pat. No. 4,525,446.

Although the precipition of silver halide crystals rich in chloride should take place in the absence of any polymeric compound(s) capable of forming hydrogen bridges with colloidal silica, but always in the presence of an onium compound, polymers or mixtures of polymers can be added as substitutes for or in addition to the onium compounds cited above, provided that at least one of these polymers acts as a "poly-onium" compound, wherein the other polymers do not have functional groups that are capable of forming hydrogen bridges with colloidal silica. It is e.g. evident that the polymers disclosed in EP-A 517 961 are excluded as they cause flocculation of silica emulsions if added in low amounts as set forth in said EP-A.

The silver halide particles of the photographic emulsions according to the present invention have a regular crystalline form, e.g. cubic or octahedral or a cubo-octahedral transition form, the cubic form however being preferred. The silver halide grains may also have a multilayered grain structure provided that at the end of the preparation a regular crystal habit is obtained.

The crystals may be doped with whatever a dope, as e.g. with $Rh^{3+}$, $Ir^{4+}$, $Cd^{2+}$, $Zn^{2+}$, $Pb^{2+}$.

During precipitation grain growth restrainers or accelerators may be added to obtain crystals with a preferred average crystal size between 0.05 and 2.5 μm. Examples of grain growth accelerators are compounds carrying e.g. a thioether function. Useful grain growth accelerators have been described in EP-A Nos. 93202049, filed Jul. 12, 1993 and 94200639, filed Mar. 11, 1994. Although there is no need for grain growth restrainers to prepare ultrafine silver halide crystals it may be useful to add one e.g. when the temperature is high in the reaction vessel. When preparing ultra fine grains in the presence of growth. restrainers, as e.g. phenylmercaptotetrazoles, it should be noted that these restrainers strongly adsorb to the silver halide crystal surface and that it is very difficult, if not impossible to remove them by washing procedures so that their influence on photographic properties persists after coating. Therefor this is preferably avoided. Ultra fine emulsions can act as seed crystals in preparation techniques, making use of Ostwald ripening or recrystallisation steps.

It is important to avoid renucleation during the growth step of the nuclei formed in the nucleation step by controlling the preferred increasing rate of addition of the silver nitrate and the halide salts rich in chloride to make the distribution of the silver halide crystals rich in chloride predictable.

Silver halide nuclei rich in choride can also be formed in a separate vessel and added to the reaction vessel wherein the growth step is performed. In the said reaction vessel additional amounts of silica and onium compound may be present.

In a preferred embodiment according to this invention it is recommended to add the silver and halide salt solutions in a vessel, provided that the concentration of the silica and of onium compound creating the "protective network" for the formed silver halide crystals rich in chloride is adapted thereto and taking into account the concentration and position in the "Hofmeister series" (lyotropic series) of the cations and anions present.

So opposite to the examples given in EP-A No. 93202679 concentrations going from 1 to 3 molar in the reaction vessel at the end of the precipitation should be avoided.

As a consequence of such a dilution it has to be recommended not to perform the desalting of the emulsion by ultrafiltration.

An especially important feature according to this invention is the protective action of the silica sol in the presence of an onium compound, thereby acting as a "network-stabilizing" agent: the mechanical forces acting during the flocculation and redispersion procedures prove that the crystal lattice is protected very efficiently and able to resist said quite strong mechanical forces thereupon.

The light-sensitive silver halide emulsion comprising silver halide crystals rich in chloride, prepared in accordance with the present invention is, after redispersion, a so-called primitive emulsion. However, said light-sensitive silver halide emulsion prepared according to the present invention can be chemically sensitized as described i.a. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silber-halogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodanines. The emulsions can be sensitized also by means of gold-sulphur ripeners or by means of reductors e.g. tin compounds as described in GB-A 789,823, amines, hydrazine derivatives, formamidine-sulphinic acids, and silane compounds. Chemical sensitization can also be performed with small amounts of It, Rh, Ru, Pb, Cd, Hg, Tl, Pd, Pt, or Au. One of these chemical sensitization methods or a combination thereof can be used. A mixture can also be made of two or more separately precipitated emulsions being chemically sensitized before mixing them.

According to this invention chemical ripening is performed before, during or after spectral sensitization. Spectral sensitization of the light-sensitive silver halide crystals rich in chloride can be performed with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the cyanine dyes, merocyanine dyes, complex merocyanine dyes.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510, cadmium salts, and azaindene compounds.

As the starting point after precipitation of the silver halide is a gelatin to silver nitrate ratio of zero, the ratio by weight of gelatin over silver nitrate is adjusted by adding an adapted amount of gelatin at the stage of or after redispersing the desalted emulsion. The ratio of silica to silver halide is determined at the stage of precipitation and/or by further addition of silica at the redispersion stage or later. According to this invention the emulsion having crystals rich in chloride is made ready for coating by addition to the emulsion of an amount of hydrogen-bridge forming polymer, e.g. gelatin, and/or silica in such an amount that the ratio of hydrogen bridge-forming polymer to silver halide expressed as silver nitrate is comprised between 0.05 and 0.40 and more preferably between 0.15 and 0.30. Otherwise the preferred ratio of silica to silver halide expressed as silver nitrate is comprised between 0.03 and 0.3 and more preferably between 0.05 and 0.15. The lower values described in this disclosure if compared to those in EP-A 528 476 are applicable thanks to the improved precipitation conditions resulting in better silica protected silver halide emulsions.

Before coating to the silver halide emulsion comprising silver halide crystals rich in chloride prepared in accordance with the present invention may be added compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are the compounds described in Research Disclosure N° 17643 (1978), Chaptre VI.

The fog-inhibiting agents or stabilizers can be added to the silver halide emulsion comprising crystals rich in chloride prior to, during, or after the chemical ripening thereof and mixtures of two or more of these compounds can be used.

The silver halide emulsions comprising silver halide crystals rich in chloride prepared in accordance with the present invention can be used to form one or more silver halide emulsion layers coated on a support to form a photographic silver halide element according to well known techniques.

Separately formed two or more different silver halide emulsions may be mixed for use in the coated layers of photographic materials according to the present invention.

The photographic element of the present invention may comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805—4,038,075—4,292,400.

The photographic element of the present invention may further comprise various other additives such as e.g. compounds improving the dimensional stability of the photographic element, UV-absorbers, spacing agents, hardeners, and plasticizers as described below.

The layers of the photographic element, especially when the binder therein used is gelatin, can be hardened with appropriate hardening agents such as those of the epoxide type, those of the ethylenimine type, those of the vinylsulfone type e.g. 1,3-vinyl-sulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts.

The emulsion having crystals rich in chloride, in accordance with this invention, may be coated on any suitable substrate such as, preferably, a thermoplastic resin e.g. polyethyelenterephtalate or a polyethylene coated paper support.

Suitable additives for improving the dimensional stability of the photographic element may be added, i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Plasticizers suitable for incorporation in the emulsions having crystals rich in chloride, prepared by the method according to the present invention are e.g. glycol, glycerine, or the latexes of neutral film forming polymers including polyvinylacetate, acrylates and methacrylates of lower alkanols, e.g. polyethylacrylate and polybutylmethacrylate.

Suitable UV-absorbers are i.a. aryl-substituted benzotriazole compounds as described in U.S. Pat. No. 3,533,794, 4-thiazolidone compounds as described in U.S. Pat. No. 3,314,794 and 3,352,681, benzophenone compounds as described in JP-A 2784/71, cinnamic ester compounds as described in U.S. Pat. No. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 μm and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Embedded in a photographic material the regular silver halide crystals rich in chloride prepared according to this invention are surrounded by colloidal silica, serving as an extremely useful protective colloid.

An especially advantageous effect resulting therefrom is the better resistance of the coated material to pressure phenomena. Emulsion layers in accordance with the present invention, and more particularly thin emulsion layers, are showing remarkable improvements concerning both resistance to stress and rapid processability compared to conventional emulsions prepared in gelatinous medium. As the ratio by weight of gelatin to silver halide decreases more pronounced pressure marks can be expected. Nevertheless as a result of the protective action of the adsorbed silica to the silver halide crystal surface much less pressure sensitivity appears.

The photographic silver halide emulsions comprising silver halide crystals rich in chloride can be used in various types of photographic elements such as i.a. in photographic elements for so-called amateur and professional photography, for graphic arts, diffusion transfer reversal photographic elements, low-speed and high-speed photographic elements, X-ray materials, micrografic materials, dry-silver materials etc.

In a preferred embodiment the photographic silver halide emulsions are used in X-ray materials.

In the precipitation conditions mentioned hereinbefore it is thus possible, not only to get very homogenous silver halide crystal size distributions for silver halide crystals rich in chloride, but also perfectly predictable average crystal sizes. As a consequence a perfect scaling up becomes available. In addition thereto a clearly decreased pressure sensitivity for the coated emulsions in various processing conditions can be attained.

The following examples illustrate the invention. All percentages are percentages by weight unless otherwise stated.

EXAMPLES

Example 1A (comparative emulsions)

A photographic silver bromoiodide emulsion containing 1.0 mole % of silver iodide was prepared by the double jet method in a vessel containing 747 ml of demineralised water, x ml of 15% silica sol 'Kieselsol 500' (trademarked product of Bayer AG), and y ml of a 5% solution of co-stabilizing phosphonium compound $(Phen)_3\text{-}P^+\text{—}CH_2\text{—}CH_2OH.Cl^-$, wherein Phen represents phenyl. The temperature was stabilized at 50° C. and the pH value was adjusted to a value of 3.0. Values for x and y are summarised in Table I.

During 5 minutes, a silver nitrate solution (2.94M) was added to the reaction vessel at a constant flow rate of 4 ml/min. Simultaneously a mixed halide solution containing 990 ml of KBr and 10 ml of KI having the same molarity of the $AgNO_3$ solution was added to the said vessel at a flow rate of the mixed halide salt solution in order to adjust the pAg at +100 mV vs. S.C.E., throughout this precipitation stage. The mixing of both solutions took place with central stirring means at 400 rpm. The pAg value was measured with a silver electrode having the temperature of the reaction vessel and a calomel reference electrode at 25° C. outside the said vessel, and wherein the connection with the reaction vessel was made with a salt bridge. After the said 5 minutes the flow rate of the silver nitrate solution was increased continously up to 50 ml/min during 36.3 minutes. The mixed halide solution was further added at an addition rate so as to maintain the same constant pAg value.

The emulsion obtained was of a cubic crystal habit and of an average grain size μ (expressed in μm) as summarised in Table I. The homogeneity of the silver halide grain distribution is expressed in the table by the value of ν, defined as the ratio between the calculated standard deviation and the value of the mean crystal diameter μ, calculated from the volume of each grain, wherein for each grain the form of a sphere was chosen schematically. the same precipitation scheme, but instead of 990 ml of potassium bromide solution, 990 ml of potassium chloride solution having the same molarity was taken in order to prepare a silver chloroiodide emulsion with 1 mole % of iodide. Values for the pH in the reaction vessel, for x and y and for the nucleation and growth pAg are summarized in Table I, together with amounts in ml of demineralised water (DW) in the reaction vessel at the start of the precipitation and an evaluation of the stability of the emulsion. Said stability was quantitatively evaluated by determining the procentual amount of silver halide sedimented 60 minutes after the end of the precipitation (% S). As a consequence a higher procentual value "% S" is indicative for a higher instability of the colloidal medium in which the precipitation takes place.

From Table I it can be concluded that for each silver chloroiodide emulsion the crystal size distributions can be considered to be very heterogeneous and that no stable colloidal medium is achieved at the end of the precipitation. It cannot be predicted, even not qualitatively, from the data of pH, pAg, amounts of demineralised water in the reaction vessel at the start of the precipitation or amounts of silica and co-stabilising onium compound how the crystal size will change.

TABLE I

| Em. No. | DW (ml) | x (ml) | y (ml) | pH | pAg (mV) | % S | μ (μm) | ν |
|---|---|---|---|---|---|---|---|---|
| 1 | 747 | 150 | 103.2 | 3.1 | +100 | 0 | 0.335 | 0.16 |
| 2 | 747 | 150 | 103.2 | 3.6 | +170 | 56 | 0.269 | 0.53 |
| 3 | 747 | 150 | 103.2 | 3.6 | +90 | 34 | 0.208 | 0.35 |
| 4 | 747 | 150 | 103.2 | 3.3 | +170 | 46 | 0.243 | 0.51 |
| 5 | 747 | 150 | 103.2 | 3.3 | +90 | 61 | 0.192 | 0.30 |
| 6 | 873 | 75 | 51.6 | 3.7 | +170 | 80 | 0.412 | 0.42 |
| 7 | 873 | 75 | 51.6 | 3.7 | +90 | 82 | 0.216 | 0.57 |

Only the silver bromoiodide emulsion prepared according to the method disclosed in EP No. 93202679 is stable (even for more than 6 hours!) and has a homogenous crystal size distribution.

Example 1B (control)

A photographic silver chlorobromide emulsion containing 2.0 mole % of silver bromide was prepared by the double jet method in a vessel containing 700 ml of demineralized water, 250 ml of 15% silica sol 'Kieselsol 500' (trademarked product of Bayer AG) and 51.6 ml of the 5% co-stabilizing phosphonium compound as in example 1A. The temperature was stabilized at 50° C., the pH value was adjusted to a value of 3.0 and the pAg to a value of +140 mV.

During 5 minutes, a silver nitrate solution (2.94M) was simultaneously added to a the reaction vessel, at a constant flow rate of 40 ml/min, together with a mixed halide solution containing 980 ml of NaCl and 20 ml of KBr having the same molarity of the $AgNO_3$ solution. The flow rate of the mixed halide salt solution was varied in such a way as to adjust the pAg at +140 mV vs. S.C.E., a value that was held constant during the whole precipitation stage. The reaction vessel was provided with central stirring means, rotating at 400 rpm. After 3 minutes the flow rate of the silver nitrate solution was increased from 10 ml/min up to 30 ml/min during 49.5 minutes and the pAg value was held constant at the same value by an adapted flow rate of the simultaneously added said mixed halide solution. Variations were made by increasing the flow rate from 5 to 25 ml/min in 66 minutes and from 3 to 25 ml/min in 70.8 minutes but it was not possible neither to get colloidally stable emulsions: already during the precipitation stage sedimentation was observed.

Example 1C (invention).

Silver chlorobromide emulsions having the same halide composition were precipitated just as in example 1B (control), except for the presence of 533 ml of 15% silica sol 'Kieselsol 500' (trademarked product of Bayer AG), 0.040 g of 3,6-dithio-1,8-octanediol and 82.5 ml of a 5% solution of the said co-stabilizing phosphonium compound. Moreover the amount of demineralised water in the reaction vessel at the start of the precipitation was 2584 ml and only 800 ml of the $AgNO_3$ solution were added and the sodium chloride solution was replaced by a potassium chloride solution of the same molarity.

During 5 minutes, the silver nitrate solution (2.9M) was simultaneously added to a the reaction vessel, at a constant flow rate of 8 ml/min. together with a mixed halide solution containing 784 ml of KCl and 16 ml of KBr having the same molarity of the $AgNO_3$ solution. The flow rate of the mixed halide salt solution was varied in such a way as to hold the pAg at +140 mV vs. S.C.E., said value being held constant during the whole precipitation stage. The reaction vessel was provided with central stirring means, rotating at 400 rpm. After 5 minutes the flow rate of the silver nitrate solution was increased from 8 ml/min up to 24 ml/min during 47.5 minutes and the pAg value was held constant at the same value by an adapted flow rate of the simultaneously added said mixed halide solution.

At the end of the precipitation an evaluation of the colloidal stability of the obtained cubic silver chlorobromide emulsion in the vessel was made, just as in Example 1A. Moreover the average diameter μ is given and the relative standard deviation ν, defined as given for Example 1A, as well as the procentual amount of renucleation (RENUC %) and the procentual amount of agglomeration (AGGL %) both determined by means of the analysis of crystal size distributions obtained by electrolytic reduction measurements from at least 1000 single silver halide crystals rich in chloride or agglomerates.

TABLE II

| Em. No. | z (ml) | RENUC (%) | AGGL (%) | % S | μ (μm) | ν |
|---|---|---|---|---|---|---|
| 1 | 0 | 6 | 15 | 0 | 0.264 | 0.25 |
| 2 | 0.4 | 20 | 10 | 0 | 0.313 | 0.32 |
| 3 | 0.8 | 3 | 10 | 0 | 0.374 | 0.17 |
| 4 | 1.2 | 3 | 7 | 0 | 0.408 | 0.14 |
| 5 | 1.6 | 3 | 6 | 0 | 0.428 | 0.13 |
| 6 | 2.0 | 5 | 4 | 0 | 0.451 | 0.14 |
| 7 | 3.0 | 4 | 10 | 0 | 0.282 | 0.18 |
| 8 | 0.8 | 3 | 13 | 0 | 0.283 | 0.21 |

From Table II it can be concluded that for each colloidal silica silver chlorobromide emulsion the crystal size distributions can be considered to be homogeneous, especially for the Emulsions Nos. 3 to 7. having a value for ν of less than 0.20 and that a very stable colloidal medium is achieved at the end of the precipitation. It is thus possible to predict the change in crystal size for silver halide crystals rich in chloride provided that the potassium salt is used as chloride salt and that the reaction vessel is much more diluted than for the preparation of colloidal silica silver bromide or bromoiodide emulsion crystals.

Example 2

(invention)

Silica silver chlorobromide emulsions having the same halide composition as in Example 1C were prepared.

Therefor 266.5 ml of 15% silica sol 'Kieselsol 500' (trademarked product of Bayer AG) and y ml of a 5% solution of a co-stabilizing onium compound were present in the reaction vessel comprising further w ml of demineralised water at the start of the precipitation. 400 ml of the $AgNO_3$ solution were added and the potassium chloride and potassium bromide solutions had the same molarity as the $AgNO_3$ solution.

During 5 minutes, the silver nitrate solution (2.94M) was simultaneously added to a the reaction vessel, at a constant flow rate of 4 ml/min, together with the mixed chlorobromide solution containing 392 ml of KCl and 8 ml of KBr. The flow rate of the mixed chlorobromide salt solution was varied in such a way as to hold the pAg at +208 mV vs. S.C.E., said value being held constant during the whole precipitation stage. The reaction vessel was provided with central stirring means, rotating at 400 rpm. After 5 minutes the flow rate of the silver nitrate solution was increased from 4 ml/min up to 12 ml/min during 47.5 minutes and the pAg value was held constant at the same value by an adapted flow rate of the simultaneously added said mixed halide solution, In Table III data are summarized for the amounts in ml of w (amount of demineralised water in the reaction vessel at the start of the precipitation), y (amount of co-stabilising onium compound), co-stabiliser (COSTAB) corresponding to formulae III-1, III-2 or 111-3, average crystal diameter and variation coefficient.

TABLE III

| Em. No. | w (ml) | y (ml) | COSTAB | μ (μm) | v |
|---|---|---|---|---|---|
| 1 | 1175.5 | 158.0 | III-1 | 0.36 | 0.14 |
| 2 | 1251.0 | 82.5 | III-2 | 0.32 | 0.22 |
| 3 | 1294.3 | 39.2 | III-3 | 0.18 | 0.27 |

The formulae for III-1, III-2 and III-3 are given hereinafter.

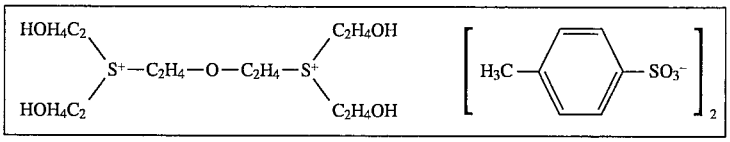

III-1

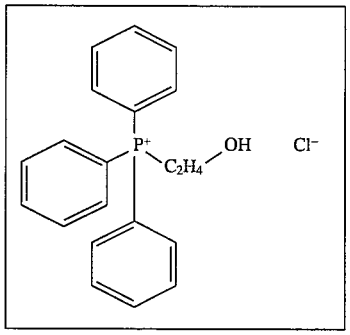

III-2

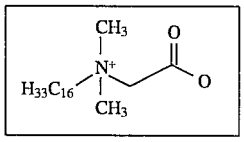

III-3

From the data summarised in Table 3 we can conclude that in a diluted medium in a reaction vessel and by making use of potassium halide salts to precipitate silver ions, it is possible to get homogeneous cubic emulsion crystals rich in chloride even when different kinds of onium compounds are added as co-stabilisers to the reaction medium comprising colloidal silica sol.

Example 3

(invention)

The purpose of these experiments is to illustrate that, according to this invention, the average crystal size has become perfectly predictable for regular silica emulsions rich in chloride as a function of variable amounts of growth accelerator at different pAg values and as a function of flow rate of the silver and halide solutions.

Therefor silica silver chlorobromide emulsions having the same halide composition as in Example 2 were prepared.

To the reaction vessel containing 2509 ml of demineralised water were added 533 ml of 15% silica sol 'Kieselsol 500' (trademarked product of Bayer AG) and 158 ml of a 5% solution of co-stabilizing onium compound 111-3. The pH was adjusted at a value of 3.0 at the start and the temperature was held at 50° C.

During 5 minutes, the silver nitrate solution (2.94M) was simultaneously added to a the reaction vessel, at a constant flow rate of 8 ml/min, together with the mixed chlorobromide solution containing 784 ml of KCl and 16 ml of KBr. The flow rate of the mixed chlorobromide salt solution was varied in such a way as to hold the pAg at +208 mV vs. S.C.E., said value being held constant during the whole precipitation stage for the first series of experiments S1 and at +140 mV for the second series S2. The reaction vessel was provided with central stirring means, rotating at 400 rpm. After 5 minutes the flow rate of the silver nitrate solution was increased from 8 ml/min up to 24 ml/min during 47.5 minutes and the pAg value was held constant at the same value by an adapted flow rate of the simultaneously added said mixed halide solution.

Table IV shows the variations of the average diameter μ of the cubic silica chlorobromide crystals as a function of the amount of growth accelerating compound 3,6-dithio-1,8-octanediol. Variable amounts of z in ml 5% (by weight) are also given in Table IV.

TABLE IV

| z (ml) | 0.4 | 0.7 | 1.0 | 2.0 | 3.0 | 4.0 | 4.8 | 6.0 |
|---|---|---|---|---|---|---|---|---|
| S1 μ (μm) | 0.47 | 0.44 | 0.48 | 0.56 | 0.62 | 0.66 | 0.68 | 0.72 |
| S2 μ (μm) | 0.40 | 0.42 | 0.44 | 0.45 | 0.50 | 0.56 | — | — |

Variable flow rates R (in ml/min) for experiments S1 with z=0 ml (thus without growth accelerator) and corresponding average crystal diameters are given in Table V.

TABLE V

| R (ml/min) | 1 | 2 | 3 | 4 |
|---|---|---|---|---|
| μ (in μm) | 0.66 | 0.48 | 0.40 | 0.36 |

Both Tables IV and V illustrate that, according to this invention it is perfectly possible to predict the average crystal size of the cubic silica silver halide crystals rich in chloride.

What is claimed is:

1. Method of preparing a photographic light-sensitive silver halide emulsion, containing regular silver halide crystals rich in chloride comprising the following steps:

precipitating silver halide crystals rich in chloride by means of a double-jet or triple-jet technique in colloidal silica having a particle size from 0.003 μm to 0.30 μm as a protective colloid in the absence of any polymeric compound(s) capable of forming hydrogen bridges with colloidal silica, but always in the presence of an onium compound, wherein a ratio by weight of said colloidal silica to said onium compound(s) is obtained between 3 and 75;

controlling nucleation and growth steps by means of variable flow rate(s) of aqueous solutions of silver nitrate and chloride containing salts, and/or by means of constant pAg-values during said steps in order to determine the number of nuclei obtained during nucleation quantitatively and to avoid renucleation growth, and wherein throughout about the nucleation and growth steps the total amount of monovalent ions of electrolyte present during both steps is less than 1.0 molar;

desalting reaction medium and redispersing silver halide formed, chemically ripening silver halide crystals rich in chloride and adjusting ratio by weight of the colloidal silica sol to amount of silver halide, expressed as equivalent amount of silver nitrate to a value of at least 0.03 throughout precipitation by addition of said silica sol.

2. Method according to claim 1, wherein a regular silver halide emulsion comprises regular silver chloride, silver chloroiodide, silver chlorobromide, with up to 25 mole % of bromide or chlorobromoiodide, with up to 25 mole % of bromide and up to 3 mole % of iodide.

3. Method according to claim 1 or 2 wherein the ratio by weight of the said colloidal silica and the said onium compound(s) is between 3 and 60.

4. Method according to claim 1 wherein during nucleation and/or growth a grain growth modifier is present.

5. Method according to claim 1 wherein said chloride containing salts are potassium salts.

6. Method according to claim 1, wherein chemical ripening is performed before, during or after spectral sensitization.

7. Method according to claim 1, wherein the emulsion comprising silver halide crystals rich in chloride is made ready for coating by addition to said emulsion of an amount of hydrogen-bridge forming polymer and/or silica in such an amount that the ratio of hydrogen bridge-forming polymer to silver halide expressed as silver nitrate is comprised between 0.05 and 0.40 and the ratio of silica to silver halide expressed as silver nitrate is comprised between 0.03 and 0.30.

8. Method according to claim 7, wherein the ratio of silica to silver halide expressed as silver nitrate is comprised between 0.05 and 0.15.

9. Method according to claim 7, wherein the said silver halide emulsion comprising silver halide crystals rich in chloride is made ready for coating by the addition of an amount of hydrogen-bridge forming polymer such that the weight ratio of the amount of hydrogen-bridge forming polymer to coated silver, expressed as equivalent amount of silver nitrate, has a value between 0.15 and 0.30.

10. Method according to claim 7, wherein the said silver halide emulsion comprising silver halide crystals rich in chloride is made ready for coating by adding silica in such an amount that weight ratio of silica to coated silver, expressed as equivalent amount of silver nitrate has a value between 0.02 and 1.0.

11. A silver halide light-sensitive photographic material having a support and, provided thereon, at least one hydrophilic colloid layer including at least one light-sensitive silver halide emulsion layer characterised in that said light-sensitive silver halide emulsion layer is coated from at least one regular silver halide emulsion comprising silver halide crystals rich in chloride, prepared by the method according to claim 1.

* * * * *